US006629404B2

(12) United States Patent
McAnany

(10) Patent No.: US 6,629,404 B2
(45) Date of Patent: Oct. 7, 2003

(54) METHOD OF AND SYSTEM FOR PACKAGING ARTICLES

(75) Inventor: Robert E. McAnany, Shawnee, KS (US)

(73) Assignee: Hallmark Cards Incorporated, Kansas City, MO (US)

( * ) Notice: Subject to any disclaimer, the term of this patent is extended or adjusted under 35 U.S.C. 154(b) by 19 days.

(21) Appl. No.: 09/775,538

(22) Filed: Feb. 1, 2001

(65) Prior Publication Data

US 2002/0100255 A1 Aug. 1, 2002

(51) Int. Cl.[7] ..... B65B 9/12
(52) U.S. Cl. ..... 53/548; 53/550; 53/511
(58) Field of Search ..... 53/452, 550, 548, 53/511, 372.7, 372.2, 375.7

(56) References Cited

U.S. PATENT DOCUMENTS

| | | | | |
|---|---|---|---|---|
| 3,762,126 A | | 10/1973 | Court | 53/55 |
| 4,077,186 A | * | 3/1978 | Voegele | |
| 4,432,185 A | | 2/1984 | Geisinger | 53/138 |
| 4,583,345 A | | 4/1986 | Hirosaki | 53/77 |
| 4,875,329 A | | 10/1989 | Miselli | 53/559 |
| 5,190,430 A | | 3/1993 | Neri | 414/412 |
| 5,197,260 A | | 3/1993 | Chevalier | 53/461 |
| 5,341,623 A | | 8/1994 | Siegel | 53/433 |
| 5,365,721 A | | 11/1994 | Focke | 53/463 |
| 5,460,844 A | * | 10/1995 | Gaylor | 53/548 |
| 5,463,842 A | | 11/1995 | Lancaster | 53/399 |
| 5,479,756 A | | 1/1996 | Haze | 53/77 |
| 5,568,718 A | | 10/1996 | Lerner | 53/75 |
| 5,570,568 A | | 11/1996 | Kramer | 53/479 |
| 5,649,409 A | | 7/1997 | Gujer | 53/461 |
| 5,746,044 A | | 5/1998 | Draghetti | 53/461 |
| 5,775,062 A | | 7/1998 | Ghini | 53/461 |
| 5,875,610 A | * | 3/1999 | Yuyama et al. | 53/550 |
| 5,941,052 A | * | 8/1999 | Evangelisti | 53/550 |
| 5,954,323 A | | 9/1999 | Emigh | 270/58.06 |
| 5,984,623 A | | 11/1999 | Smith | 414/797 |
| 6,212,859 B1 | * | 4/2001 | Bielik et al. | 53/550 |

* cited by examiner

*Primary Examiner*—Eugene Kim
*Assistant Examiner*—Sameh Tawfik
(74) *Attorney, Agent, or Firm*—Pillsbury Winthrop LLP

(57) ABSTRACT

A system for packaging articles, such as stacks of greeting cards or the like, includes an article handler, a group of film handlers, and a side sealer. Each of the film handlers includes a film roll holder, which is adapted to hold a roll of folded over film having a closed side and an open side. The film handler also includes a film holding arrangement adapted to hold open the film along an open side, and cross cutter including an end cutting and sealing blade arrangement positioned transverse to the length of the film and adapted to cut and seal an end of the film adjacent an end of an article. The article handler is positioned adjacent the film handlers. The article handler is adapted to deliver an article to a film handler selected to have a film width greater than the width of the article and to insert the article into the film holding arrangement of the selected film handler through the open side of said film and move the article and film past the cross cutter, whereupon the end cutting and sealing blade is actuated to cut and seal said film adjacent an end of the article. The side sealer includes a side cutting and sealing blade arrangement positioned cut to and seal the open side of said film adjacent a side of the article.

21 Claims, 6 Drawing Sheets

METHOD OF AND SYSTEM FOR PACKAGING ARTICLES

FIELD OF THE INVENTION

The present invention relates generally to the field of article packaging, and more particularly to a method and system for sequentially packing articles of different sizes in plastic film, wherein the film substantially exactly fits the article while reducing the amount of wasted film material.

DESCRIPTION OF THE PRIOR ART

Social expression cards and greeting cards are manufactured and sold in a variety of shapes, sizes, and styles, to provide customers a wide selection of cards. Currently, cards are manufactured in large production runs, wherein literally thousands of identical cards are manufactured. A production run generally includes the steps of printing, scoring, cutting, folding, and packaging the cards. Each of those steps currently requires a substantial amount of make ready.

There is a desire to be able to produce cards on demand in smaller runs. For example, it may be desired to produce only from one to a few dozen cards of a particular design. The make ready requirements for current manufacturing techniques make it uneconomical to produce cards in such limited quantities.

The make ready requirements are particularly severe with respect to packaging. Currently, there do not exist any on demand plastic wrap packaging systems. Rather, packaging equipment must be set up and configured to make a package of a particular size and shape. If one were to attempt to use currently existing packaging equipment to package articles of different sizes in an on demand production system, one would have to use a least common denominator approach. In other words, one would have to package all the articles in a package large enough to fit the largest article, which would lead to substantial waste of packaging material. The problem could be ameliorated somewhat by using shrink wrap material, but such material is substantially more expensive than common heat sealable polyethylene material.

It is therefore an object of the present invention to provide a method and system for sequentially packing articles of different sizes in plastic film, wherein the film substantially exactly fits the article while reducing the amount of wasted film material.

SUMMARY OF THE INVENTION

The present invention provides a method of and a system for packaging articles, such as stacks of greeting cards or the like, having ends and sides. The system of the present invention includes an article handler, a plurality of film handlers, and a side sealer.

Each of the film handlers includes a film roll holder for holding a film roll. Each film has a length and a width, wherein the film is folded along its length to have an open side and a closed side. The film rolls each have a different width between the respective open and closed ends of the films they carry. Each film handler further includes a film holding arrangement positioned to receive film from the film roll holder. The film holding arrangement is adapted to hold open the film along its open side. Finally, each film handler includes a cross cutter positioned to receive film from the film holding arrangement The cross cutter includes an end cutting and sealing blade positioned transverse to the length of the film and adapted to cut and seal an end of the film adjacent an end of an article.

The article handler is positioned adjacent the film handlers. The article handler is adapted to deliver an article to a film handler selected to have a film width greater than the width of the article and to insert the article into the film holding arrangement of the selected film handler through the open side of said film and move the article and film past the cross cutter, whereupon the end cutting and sealing blade is actuated to cut and seal said film adjacent an end of the article.

The side sealer is positioned adjacent the article handler. The side sealer includes a side cutting and sealing blade positioned cut and seal said open side of said film adjacent a side of said article. The side sealer includes a gripper positioned to receive an article from the article handler with the film being sealed on either end of the article. The gripper is arranged to position the side of the article adjacent the open side of the film adjacent the side cutting and sealing blade. The side cutting and sealing blade is actuated to cut and seal film closely adjacent the side of the article.

DESCRIPTION OF THE PREFERRED EMBODIMENT

Figure 1:
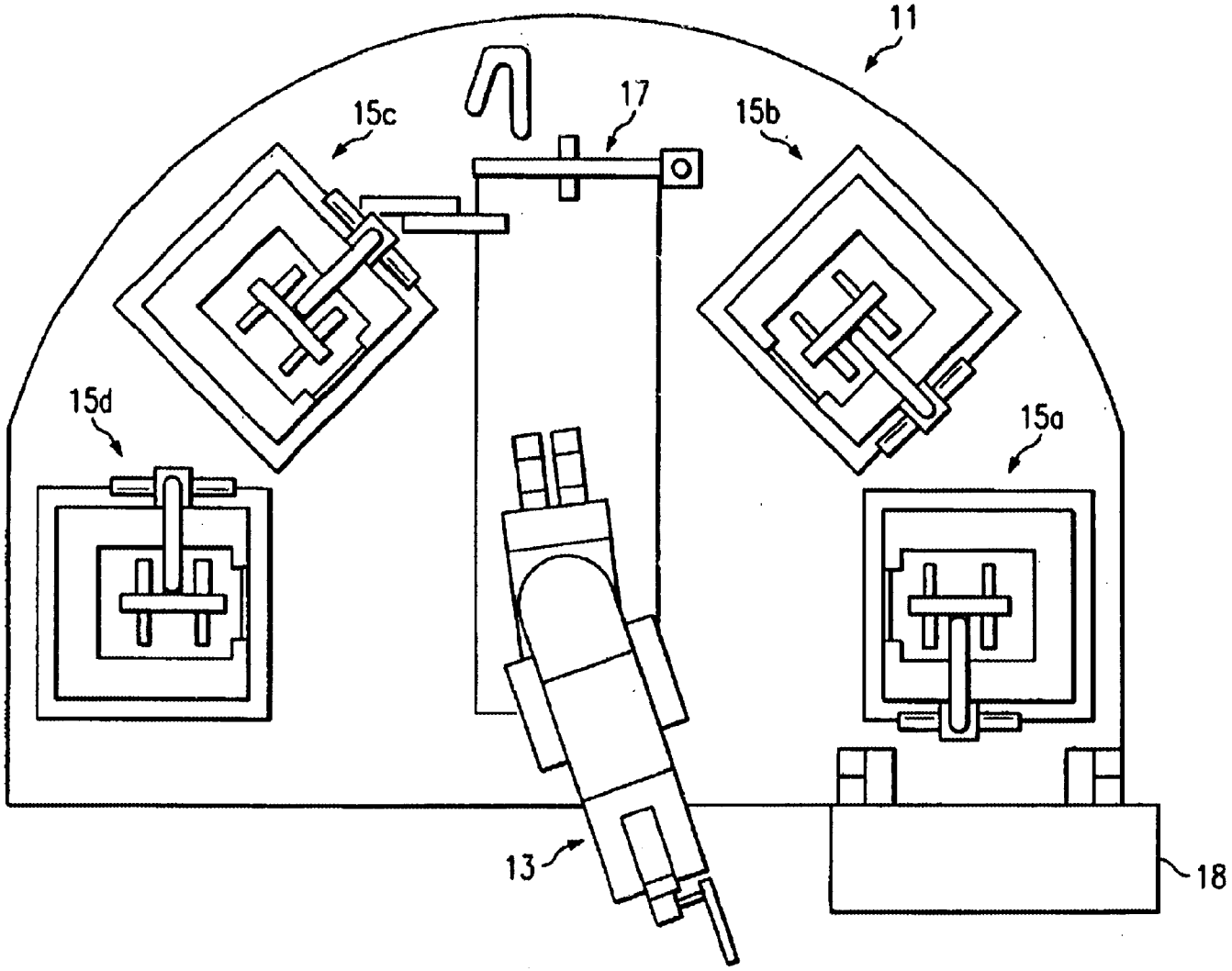
FIG. 1 is a top view of a system according to the present invention.

Referring now to the drawings, first to FIG. 1, the system according to the present invention is designated generally by the numeral 11. System 11 includes an article handler 13, a plurality of film handlers 15, and a side sealer 17. In the preferred embodiment, article handler 13 is an articulated arm, six-axis robot of the type well-known in the art. A preferred robot according to the present invention is the FANUC LR Mate 200i, manufactured by FANUC Robotics North America Inc., of Rochester Hills, Mich. Those skilled in the art will recognize that other robotic devices may be used according to the present invention. Additionally, those skilled in the art will appreciate that alternative article handling arrangements may be, given the benefit of this disclosure.

Referring still to FIG. 1, film handlers 15 are disposed within reach of material handler 13. The construction and operation of each film handler 15 will described in detail hereinafter. Each film handler 15 is adapted to handle heat sealable plastic sheet material, which in the preferred embodiment is polyethylene film. As will be explained in detail hereinafter, the polyethylene film takes the form of a long strip folded in half along its long axis to form a long double strip having a closed side and an open side. The folded strip is wound into a roll, which is carried by a film handler 15. According to the present invention, each film handler 15 carries a roll of a different width material. As will be explained in detail hereinafter, article handler 13 is operated to select a film handler 15 having a film width sufficient to accommodate the articles being packaged, but without excess waste being created.

The system of the present invention includes a controller 18, which controls the operation of article handler 13, film handlers 15, and side sealer 17. Controller 18 is provided with information on the dimensions of the articles currently being packaged. Controller 18 operates article handler 13 to select the film handler 15 appropriate for the width of the article, and to position and move the article appropriately with respect to film handler 15. Controller 18 operates film handler 15 and side sealer 17 to seal and cut the film, as will be described in detail.

Figure 2:
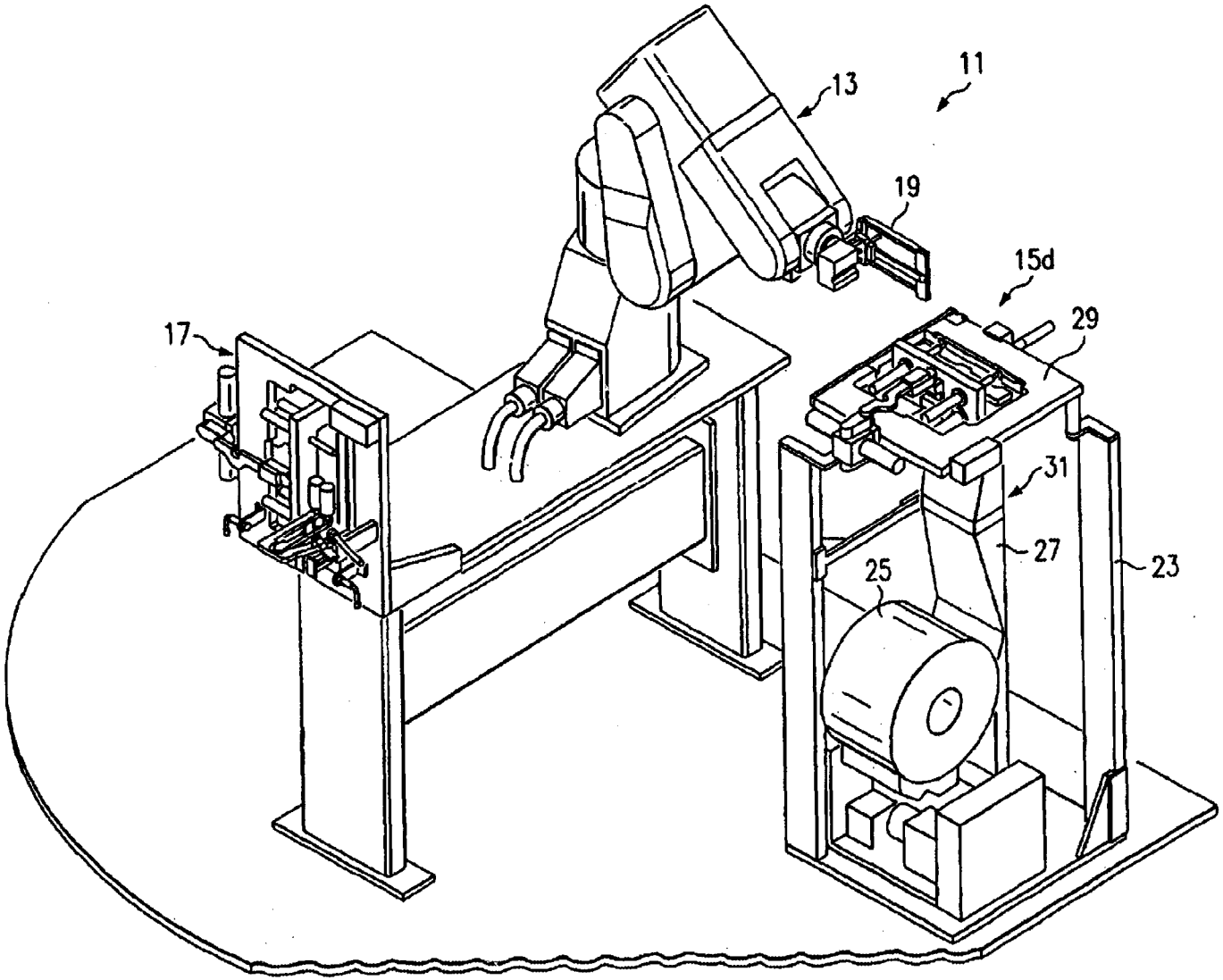
FIG. 2 is a is perspective view showing components of the system of the present invention.

Referring now to FIG. 2, there is shown further detail of material handler 13, one film handler 15*d*, and side sealer 17. As shown in FIG. 2, article handler 13 includes an article gripper 19, which is adapted to grip the articles to be packaged, which in the preferred embodiment are stacks of cards and envelopes. Film handler 15 includes a frame 23 that includes at least three legs. Frame 23 supports a film roll 25, which carries film 27, folded according to the present invention. Film 27 is trained between roll 25 and a cross cutter 29 through a film holding arrangement 31. Film holding arrangement 31 is adapted to hold open the open side of film 27 so that articles may be inserted there into by article handler 13.

Figure 3:
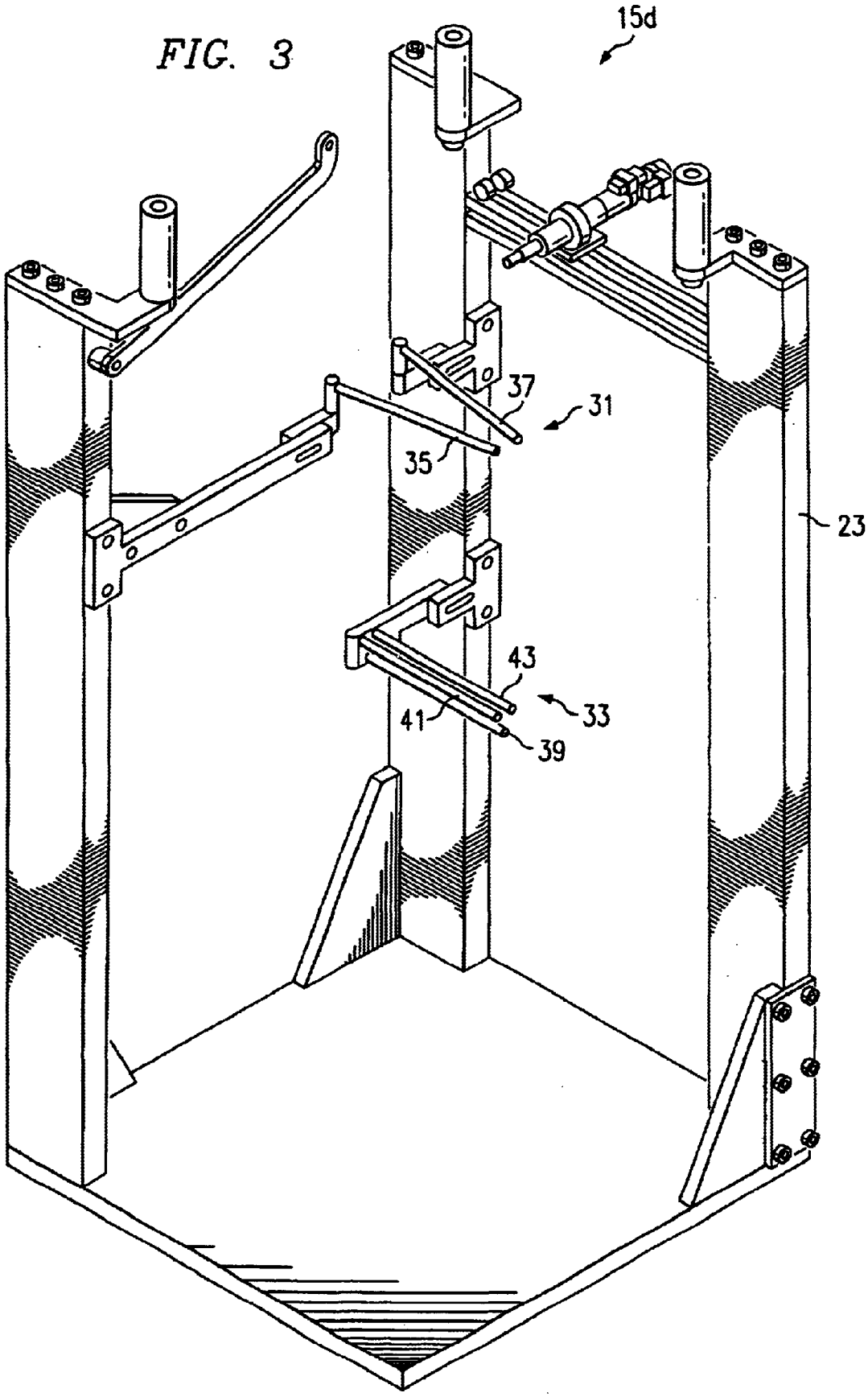
FIG. 3 is a perspective view showing details of a film handler according to the present invention.

Referring now to FIG. 3, there is shown details of film holder 31 according to the present invention. Film holder 31 includes a film guide 33 and a pair of relatively widely spaced apart fingers 35 and 37 positioned above film guide 33. Film guide 33 includes a first finger 39 and a pair of closely spaced apart substantially parallel fingers 41 and 43 positioned closely above finger 39. The film (not shown for purposes of clarity in FIG. 3) passes over finger 39 and between fingers 41 and 43 and thence over fingers 35 and 37 toward cross cutter 29 (shown in FIG. 2). Fingers 35 and 37 hold open the open side of the film so that articles may be inserted therebetween and within the film.

Figure 4:
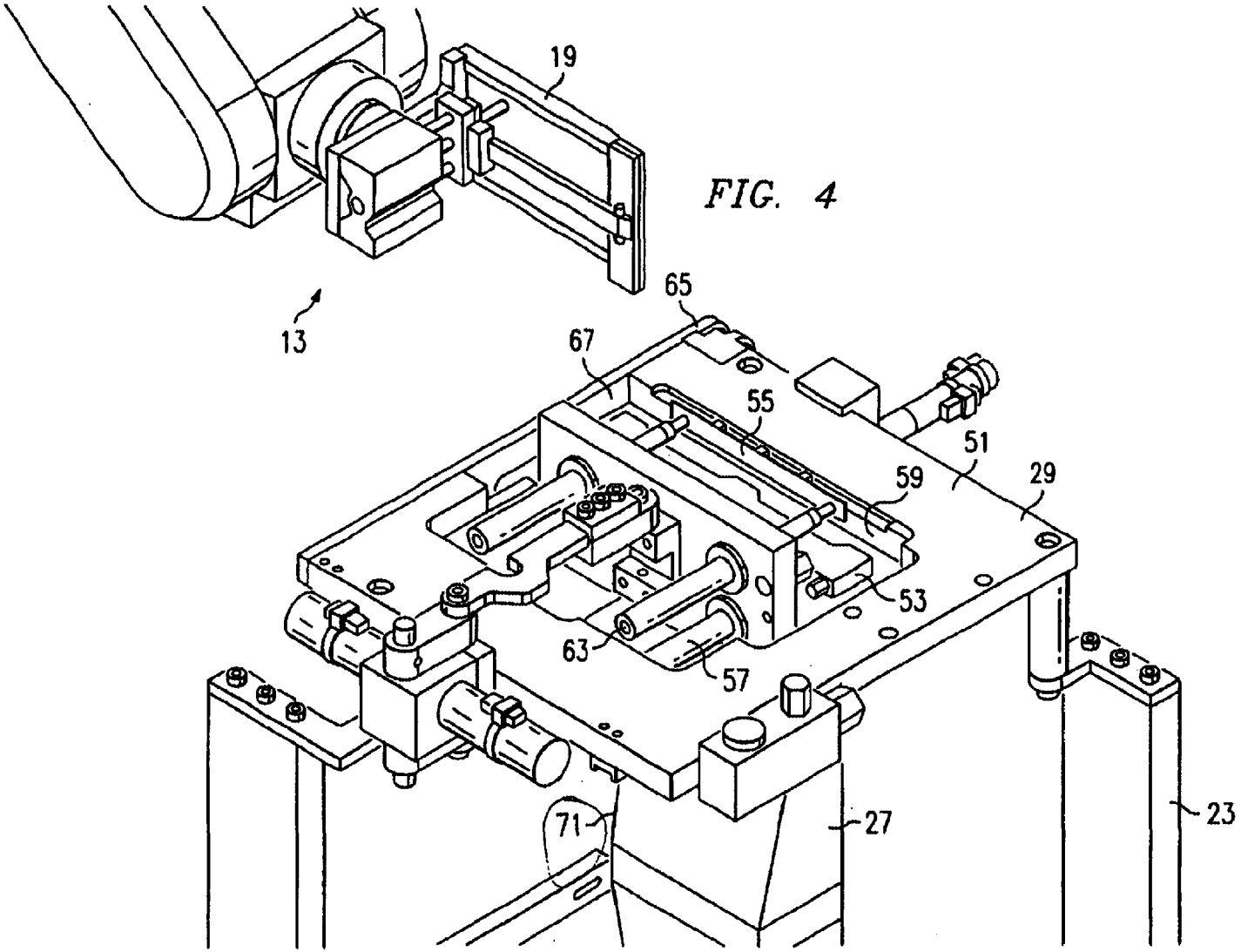
FIG. 4 is a perspective view showing details of a cross cutter according to the present invention.

Referring now to FIG. 4, cross cutter 29 includes a plate 51 mounted to frame 23. Plate 51 carries a heat sealing and cutting mechanism 53 and film holding arrangement 55. Heated blade arrangement 53 is mounted parallel to plate 51 and transverse to film 27. Heated blade 53 is moved in the plane of plate 51 by actuators 57 into and out of engagement with a platen 59 to heat seal and cut film 27. Film holder 55 is also mounted parallel to plate 51 and transverse to the movement of film 27. Film holder 55 is moved in the plane of plate 51 by actuators 63 into and out of engagement with film 27. Cross cutter 29 also includes a pivoting arm 65 mounted to plate 51. Arm 65 is adapted to pivot with respect to plate 51 so as to form a lateral opening 67 through which article holder 19 may pass upwardly through plate 51 during operation of the system of the present invention. When article holder 19 is clear of plate 51, arm 51 is pivoted back to the position shown in FIG. 4 to impart rigidity to plate 51 during actuation of heated blade 53.

In operation, article holder 19 holds the articles to be packaged, which in the preferred embodiment is a stack of greeting cards and envelopes, vertically below plate 51 of cross cutter 29. Article handler 13 is actuated to insert article holder 13, with the articles to be packaged, horizontally into the open side 71 of film 27. During the previous operation of cross cutter 29, the upper end of film 27 is sealed and held in place within cross cutter 29 by film holder 55. When article holder 19 is fully inserted into film 27 through open side 71, actuators 57 and 63 are actuated to retract heated blade 53 and film holder 55. Then, article handler 13 is actuated to move article holder 19 vertically upward through the plane of plate 51. The upper end of the articles engages the sealed end of film 27. Further upward movement of article holder 19 pulls film off roll 25. When the lower end of the article to be packaged clear the plane of plate 51, actuators 57 and 63 are actuated to close heated blade 53 and film holder 55. Heated blade 53 seals and cuts film 27 thereby to form a partial package around the articles. The partial package is sealed closely above and below the ends of the articles.

Figure 5:
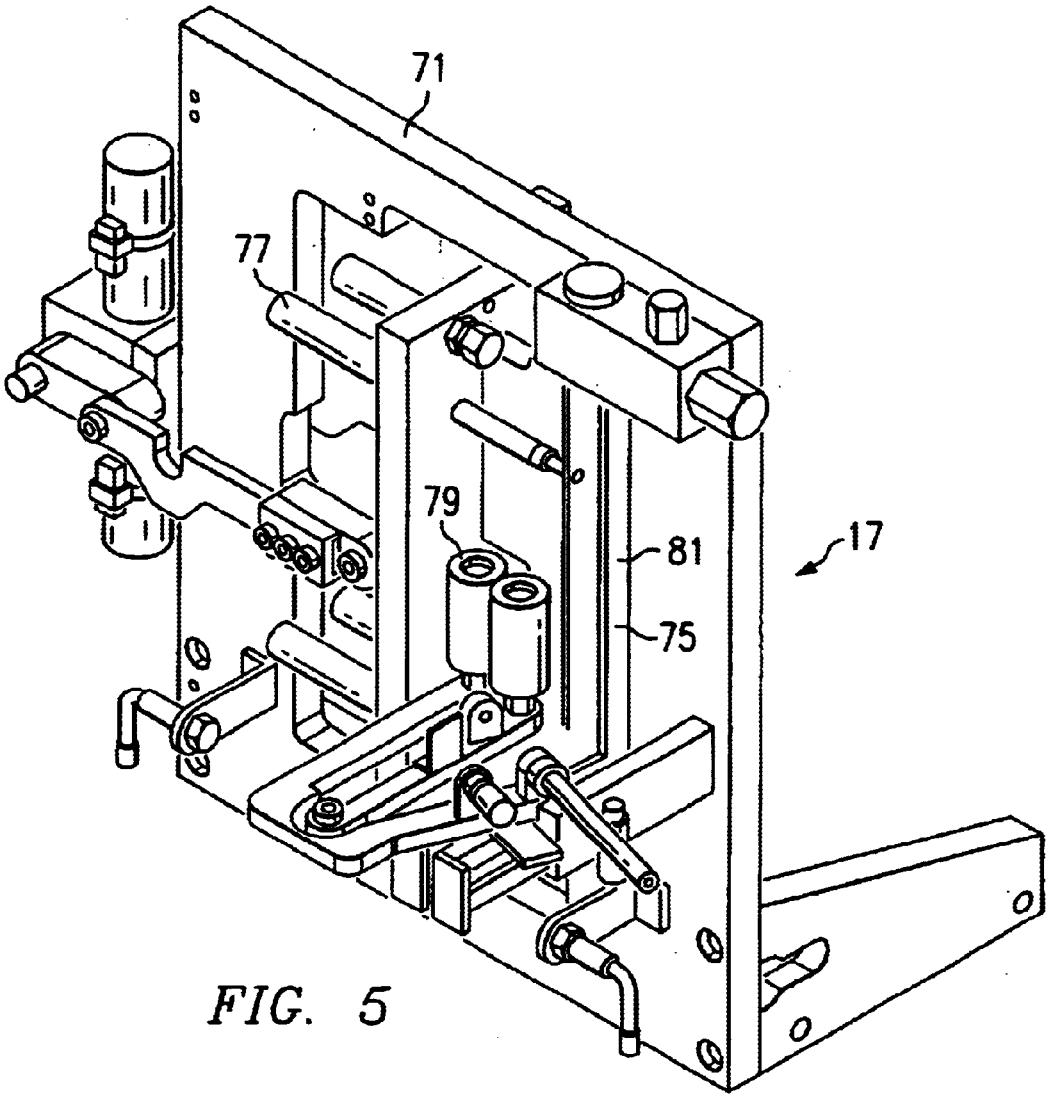
FIG. 5 is a perspective view showing details of a side sealer according to the present invention.

Referring now to FIG. 5, there is shown details of side sealer 17 according to the present invention. Side sealer 17 is similar to cross cutter 29 in that it includes a plate 71 that carries a heated blade cutting and sealing instrument 75. Heated blade 75 is moved in the plane of plate 71 by actuators 77 into and out of engagement with a platen (not shown) to seal and cut the film.

Side sealer 17 includes a gripper arrangement mounted on the back side of plate 71. Gripper 79 is adapted to receive partially packaged articles from article holder 19 of article handler 13 through an opening 81 in plate 71 when heated blade 75 is retracted. Gripper 79 then moves the articles horizontally through the plane of plate 71 until the edge of the article clears heated blade 75. Then, actuators 77 are actuated to close heated blade 75, thereby to seal and cut the edge of the package.

Figure 6:
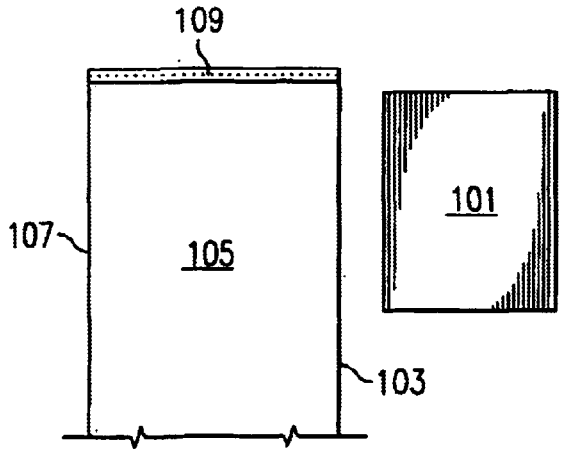
FIGS. 6–11 comprise a series of views illustrating the steps of the method of the present invention.
Figure 7:
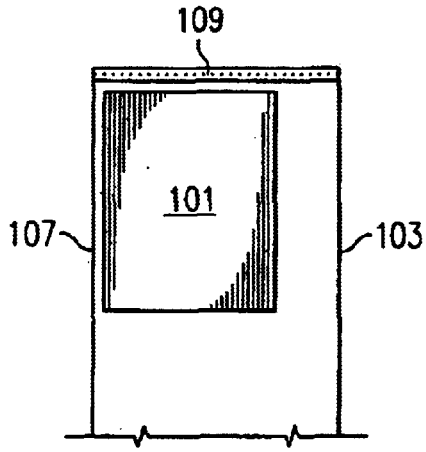
Figure 8:
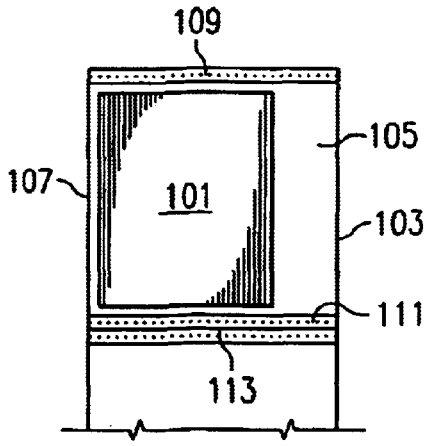
Figure 9:
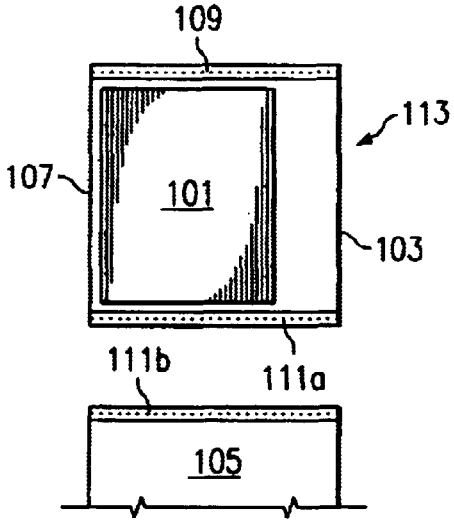
Figure 10:
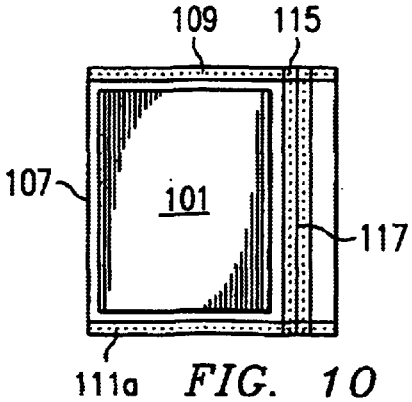
Figure 11:
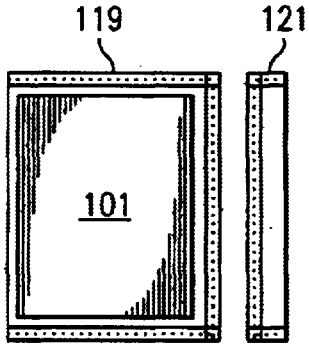

The method of the present invention is illustrated with respect to FIGS. 6–11. In FIG. 6, a stack of cards 101 is positioned laterally adjacent the open side 103 of a strip of material 105. Material 105 is folded over so as to define a closed side 107. The upper end of strip 105 is sealed as indicated at 109. As shown in FIG. 7, the stack of articles is inserted sideways through open side 103 into a position closely adjacent closed side 107 and sealed edge 109. Then, as shown in FIG. 8, film 105 is sealed, as indicated at 111, closely below the lower end of articles 101. Concurrently with sealing film 105 at 111, a cut 113 is made through seal 111, thereby allowing a partial package 113 to be separated from the remainder of film 105. As shown in FIG. 9, partial package 113 is sealed on its ends by seals 109 and 111A and at its left-most side by the closed end of the film. Partial package 113 is open along side 103. Then, referring to FIG. 10, a seal 115 is formed closely adjacent the right-most side of article 101. Concurrently with forming seal 115, a cut 117 is made through seal 115. As shown in FIG. 11, a completed package 119 is formed by removing scrap 121.

From the foregoing, it may been seen that the present invention provides a packaging system well adapted to overcome the shortcomings of the prior art. The plural film handlers provide films of different widths. By selecting the appropriate film handler, the system of the present invention minimizes the amount of waste material. According to the present invention, the article handler cooperates with the cross cutter and the side cutter seal the edges close to the articles, thereby producing a tight package.

The invention has been illustrated and described with respect to a presently preferred embodiment. Those skilled in the art will recognize alternative arrangements and embodiments, given the benefit of this description. Accordingly, the foregoing description is intended for purposes of illustration rather than limitation.

What is claimed is:

1. A system for packaging articles, said articles having ends and sides, which comprises:

an article handler for handling articles to be packaged, said article handler including a first gripper arranged to grip said articles to be packaged;

a film handler positioned adjacent said article handler, said film handler including:

a film roll holder for holding a film roll, said film having a length and a width, said film being folded along the length thereof to have an open side and closed side;

a film holding arrangement positioned to receive film from said film roll holder, said film holding arrangement being adapted to hold open said film along said open side;

a cross cutter positioned to receive film from said film holding arrangement, said cross cutter including an end cutting and sealing blade arrangement positioned transverse to the length of said film and adapted to cut and seal an end of said film adjacent an end of said article; and, a side sealer positioned adjacent said article handler, said side sealer including a side cutting and sealing blade arrangement positioned to cut and seal said open side of said film adjacent a side of said article, said side sealer including a second gripper positioned to receive an article from said first gripper with said film being sealed on either end of said article, said second gripper being arranged to position the side of said article adjacent said open side of said film adjacent said side cutting and sealing blade arrangement.

2. The system as claimed in claim 1, wherein said article handler includes a robot.

3. The system as claimed in claim 1, wherein said film holding arrangement includes:

a pair of spaced apart fingers positioned between said film roll holder and said cross cutter, said film being trained around said fingers to hold open said open side of said film.

4. The system as claimed in claim 3, wherein said film holding arrangement includes:

a film guide positioned between said film roll holder and said spaced apart fingers, said film being trained through said film guide to hold closed said open side of said film.

5. The system as claimed in claim 1, wherein said article comprises a stack of cards.

6. The system as claimed in claim 1, wherein said side sealer includes:

a plate having an opening therethrough, said side cutting and sealing blade arrangement being mounted to said plate, wherein said first gripper is arranged to insert an article with said film being sealed on either end of said article into said opening.

7. The system as claimed in claim 6, wherein said second gripper is positioned to receive an article with said film being sealed on either end of said article inserted by said first gripper through said opening and move said article to a position in which the side of the article adjacent said open side of said film is adjacent said side cutting and sealing blade arrangement.

8. A system for packaging articles, said articles having ends and sides, which comprises:

a film handler including:

a film roll holder for holding a film roll, said film having a length and a width, said film being folded along the length thereof to have an open side and closed side;

a film holding arrangement positioned to receive film from said film roll holder, said film holding arrangement being adapted to hold open said film along said open side;

a cross cutter positioned to receive film from said film holding arrangement, said cross cutter including an end cutting and sealing blade arrangement positioned transverse to the length of said film and adapted to cut and seal an end of said film adjacent an end of said article;

an article handler positioned adjacent said film handler, said article handler including a first gripper arranged to grip an article, said first gripper being adapted to insert an article into said film holding arrangement through said open side of said film and move said article and film past said cross cutter, whereupon said end cutting and sealing blade is actuated to cut and seal said film adjacent an end of said article; and, a side sealer positioned adjacent said article handler, said side sealer including a side cutting and sealing blade arrangement positioned cut and seal said open side of said film adjacent a side of said article, said side sealer including a second gripper positioned to receive an article from said first gripper with said film being sealed on either end of said article, said second gripper being arranged to position the side of said article adjacent said open side of said film adjacent said side cutting and sealing blade arrangement.

9. The system as claimed in claim 8, wherein said article handler includes a robot.

10. The system as claimed in claim 8, wherein said film holding arrangement includes:

a pair of spaced apart fingers positioned between said film roll holder and said cross cutter, said film being trained around said fingers to hold open said open side of said film.

11. The system as claimed in claim 10, wherein said film holding arrangement includes:

a film guide positioned between said film roll holder and said spaced apart fingers, said film being trained through said film guide to hold closed said open side of said film.

12. The system as claimed in claim 8, wherein said article comprises a stack of cards.

13. The system as claimed in claim 8, wherein said side sealer includes:

a plate having an opening therethrough, said side cutting and sealing blade arrangement being mounted to said plate, wherein said first gripper is arranged to insert an article with said film being sealed on either end of said article into said opening.

14. The system as claimed in claim 13, wherein said second gripper is positioned to receive an article with said film being sealed on either end of said article inserted by said first gripper through said opening and move said article to a position in which the side of the article adjacent said open side of said film is adjacent said side cutting and sealing blade arrangement.

15. A system for packaging articles, said articles having ends and sides, which comprises:

a plurality of film handlers, each of said film handlers including:

a film roll holder for holding a film roll, said film having a length and a width, said film being folded along the length thereof to have an open side and closed side;

a film holding arrangement positioned to receive film from said film roll holder, said film holding arrangement being adapted to hold open said film along said open side;

a cross cutter positioned to receive film from said film holding arrangement, said cross cutter including an end cutting and sealing blade arrangement positioned transverse to the length of said film and adapted to cut and seal an end of said film adjacent an end of said article; wherein each of said film handlers handles film of a different width;

an article handler positioned adjacent said film handlers, said article handler including a first gripper arranged to grip an article, said first gripper being adapted to deliver an article to a film handler selected to have a film width greater than the width of said article and to insert said article into said film holding arrangement of said selected film handler through said open side of said film and move said article and film past said cross cutter, whereupon said end cutting and sealing blade is actuated to cut and seal said film adjacent an end of said article; and, a side sealer positioned adjacent said article handler, said side sealer including a side cutting and sealing blade arrangement positioned to cut and seal said open side of said film adjacent a side of said article, said side sealer including a second gripper positioned to receive an article from said first gripper with said film being sealed on either end of said article, said gripper being arranged to position the side of said article adjacent said open side of said film adjacent said side cutting and sealing blade arrangement.

16. The system as claimed in claim 15, wherein said article handler includes a robot.

17. The system as claimed in claim 15, wherein each said film holding arrangement includes:

a pair of spaced apart fingers positioned between said film roll holder and said cross cutter, said film being trained around said fingers to hold open said open side of said film.

18. The system as claimed in claim 17, wherein each said film holding arrangement includes:

a film guide positioned between said film roll holder and said spaced apart fingers, said film being trained through said film guide to hold closed said open side of said film.

19. The system as claimed in claim 15, wherein said article comprises a stack of cards.

20. The system as claimed in claim 15, wherein said side sealer includes:

a plate having an opening therethrough, said side cutting and sealing blade arrangement being mounted to said plate, wherein said first gripper is arranged to insert an article with said film being sealed on either end of said article into said opening.

21. The system as claimed in claim 20, wherein said second gripper is positioned to receive an article with said film being sealed on either end of said article inserted by said first gripper through said opening and move said article to a position in which the side of the article adjacent said open side of said film is adjacent said side cutting and sealing blade arrangement.

* * * * *